United States Patent [19]

Bockhorst et al.

[11] Patent Number: 4,597,067

[45] Date of Patent: Jun. 24, 1986

[54] BOREHOLE MONITORING DEVICE AND METHOD

[75] Inventors: Rhea W. Bockhorst, Morgantown; David A. Christopher, Idamay, both of W. Va.; Stephen D. Lauer, Waynesburg, Pa.

[73] Assignee: Conoco Inc., Wilmington, Del.

[21] Appl. No.: 601,419

[22] Filed: Apr. 18, 1984

[51] Int. Cl.[4] ..... H04H 9/00; E21D 10/00; G01V 1/00

[52] U.S. Cl. ..... 367/82; 175/40; 175/62; 181/102; 340/861

[58] Field of Search ..... 175/39, 40, 41, 45, 175/62; 340/853, 854, 861; 367/25, 27, 33, 34, 35, 81, 82, 83, 86, 911, 912; 181/102, 104, 105, 106; 166/73

[56] References Cited

U.S. PATENT DOCUMENTS

| | | | |
|---|---|---|---|
| 3,448,612 | 6/1969 | Lebourg | 367/81 X |
| 3,771,118 | 11/1973 | Lichte, Jr. et al. | 340/861 |
| 3,790,930 | 2/1974 | Lamel et al. | 367/82 |
| 3,876,016 | 4/1975 | Sharon | 175/45 |
| 3,900,827 | 8/1975 | Lamel et al. | 367/82 |
| 3,906,434 | 9/1975 | Lamel et al. | 367/81 X |
| 3,977,245 | 8/1976 | Clark et al. | 367/81 X |
| 4,001,773 | 1/1977 | Lamel et al. | 175/40 |
| 4,019,148 | 4/1977 | Shawhan | 328/167 |
| 4,021,773 | 5/1977 | Keenan | 367/82 |
| 4,066,995 | 1/1978 | Matthews | 175/56 |
| 4,157,659 | 6/1979 | Murdoch | 367/81 |
| 4,283,780 | 8/1981 | Nardi | 310/322 |
| 4,293,936 | 10/1981 | Cox et al. | 367/82 |
| 4,324,297 | 4/1982 | Denison | 73/151 |
| 4,386,664 | 6/1983 | Miller | 175/45 |
| 4,387,774 | 6/1983 | Herbert | 175/40 |
| 4,390,975 | 6/1983 | Shawhan | 175/40 |
| 4,391,336 | 7/1983 | Coon et al. | 175/45 |
| 4,445,578 | 5/1984 | Millheim | 73/151 |
| 4,454,598 | 6/1984 | Claycomb | 361/83 |
| 4,460,059 | 7/1984 | Katz | 181/102 |
| 4,520,468 | 5/1985 | Scherbatshoy | 367/83 |

OTHER PUBLICATIONS

Journal of Petroleum Technology, Oct. 1983, pp. 1792–1796, Kamp, "Downhole Telemetry from the User's Point of View".

*Primary Examiner*—Charles T. Jordan
*Assistant Examiner*—Brian Scott Steinberger
*Attorney, Agent, or Firm*—William A. Mikesell; Cortlan R. Schupbach

[57] ABSTRACT

A method and device for sensing hole parameters while drilling a borehole, and transmitting the sensed data to a remote receiver. Data are transmitted in digital format as a series of audible binary pulses generated by a solenoid acoustically coupled to the drill pipe. In a preferred embodiment, data transmission occurs automatically during periods of drilling inactivity.

2 Claims, 3 Drawing Figures

BOREHOLE MONITORING DEVICE AND METHOD

DISCUSSION OF PRIOR ART

Various procedures have been used to determine conditions such as direction, pressure, or relationship to an adjacent formation, during drilling of a borehole, and for retrieving the data from the borehole. U.S. Pat. No. 3,771,118 discusses the procedure where the entire drill string is periodically pulled from the hole, and replaced by some sort of surveying tool which either records the data, as on film, or transmits it to the working face via a connecting electrical cable.

Another approach is suggested in U.S. Pat. Nos. 3,790,930 and 4,001,773, whereby data are transmitted acoustically from within the borehole by the drill string, either during drilling or during pauses in the drilling operation, by torsional waves.

It has also been proposed, as for example in U.S. Pat. Nos. 4,019,148, 4,293,936, and 4,390,975, to generate data in a binary form, and to utilize such data for frequency-shift-keyed modulation of an acoustic signal which can be transmitted, via repeaters as may be desired, by the drill pipe.

Various elements useful in acoustic data telemetry are shown in the art, as for example a pick-up shown in U.S. Pat. No. 4,021,773, an acoustic isolator shown in U.S. Pat. No. 4,066,995, and a resonant acoustic transducer shown in U.S. Pat. No. 4,283,780. A specialized system for acoustically guiding the drilling of a second hole parallel to an existing first borehole is shown in U.S. Pat. No. 4,391,336. And U.S. Pat. No. 4,386,664 discloses a method of controlling the direction of drilling a substantially horizontal borehole, as for drainage of methane from a coal seam.

Finally, a survey of downhole telemetry has been published in *Journal of Petroleum Technology* for October 1983, at pages 1792–1796, by Kamp under the title "Downhole Telemetry from the User's Point of View".

OBJECTS AND SUMMARY OF THE INVENTION

It is an object of the present invention to provide for wireless telemetry of borehole data utilizing a transmitter which is both physically rugged and simple to operate and maintain. Many of the systems used heretofore are sufficiently complex to use, interpret, and maintain, that an industry of well-logging specialists exists.

According to the present invention there is provided a wellbore data telemetry system whereby the data are transmitted as encoded audible binary pulses from a self-contained transmitter, along the drill string to the working face, where they are decoded. The pulses are generated by activation of an electrical solenoid, the body of which is acoustically coupled to the drill string. In a preferred embodiment, the data transmission cycle is initiated by the transmitter's sensing a predetermined interval of drilling inactivity. In another preferred embodiment, power to the sensing elements in the transmitter is disconnected upon the transmitter's sensing a longer predetermined interval of drilling inactivity.

DETAILED DESCRIPTION OF THE INVENTION

Figure 1:
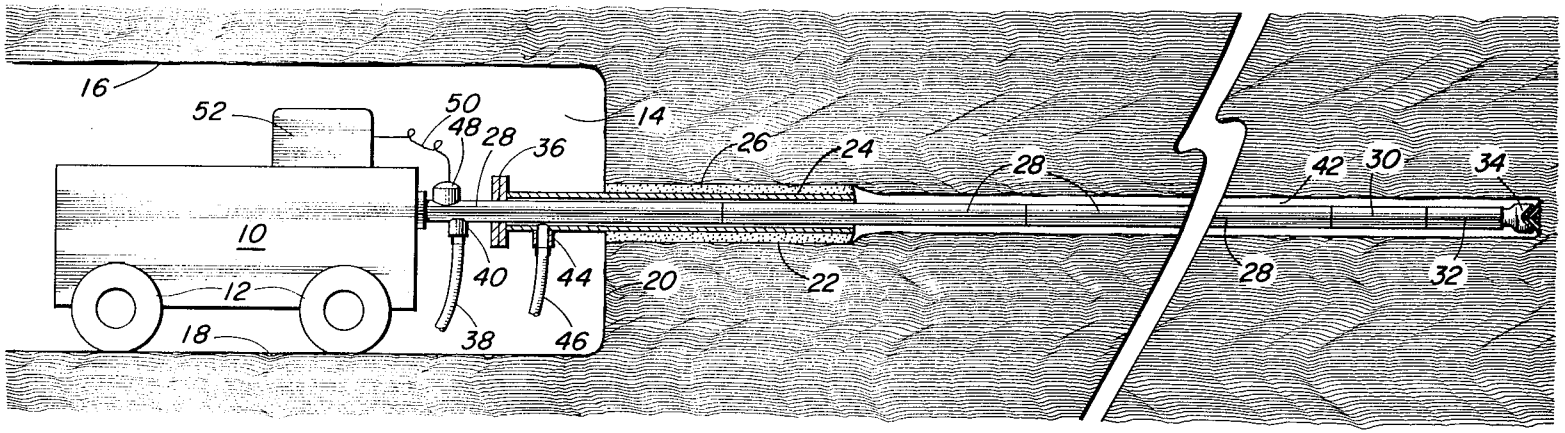
FIG. 1 is a view, partially in elevation and partially in section, of a telemetry installation in a horizontal borehole according to the present invention.

Referring now to the drawing, and to FIG. 1 in particular, there is shown a drilling machine 10 supported on wheels 12, or an endless tread arrangement, which is adapted to exert a thrust in a forward direction. Machine 10 is shown within a mined-out cavity 14 comprised of a ceiling 16 and a floor 18. The machine is positioned adjacent the face 20 of a generally horizontally-extending seam, such as a coal seam, into which a horizontal hole is being drilled. According to the drilling procedure, an oversize hole 22 is first drilled, and then a metal sleeve or casing 24 is inserted into the hole, and is fastened in position as by squeezing cement 26 into the annular space outside casing 24 and within hole 22. Next, machine 10 is fitted with one or more sections of drill rod 28 and, on the leading end, guidance transmitter 30 and downhole motor 32 equipped with a rotary drill bit 34. At the point where rod 28 enters casing 24, there is provided a sealing gland 36. High pressure water from a source not shown is supplied from a hose 38 through a fitting 40 into the hollow interior of rod 28. The high pressure water travels the length of rod 28 to motor 32, providing the power to turn motor 32 and thus bit 34, and also serves to cool bit 34 as it is discharged from ports in the bit. The discharged water then travels back out the borehole in the annulus 42 outside drill rod 28, carrying with it cuttings from the hole being drilled. Water and cuttings are carried away through a fitting 44 attached to casing 24, and thence out hose 46 attached to fitting 44. Finally, a sonic detector 48 such as a piezoelectric accelerometer, in contact with rod 28, is connected by electrical wire 50 to a read-out display device 52.

It will be recognized that the preceding description utilizes a downhole motor to rotate bit 34, and thus the drilling operation requires only axial movement or thrust on drill rod sections 28 by machine 10. However, the guidance system of this invention is equally useful for rotary drilling, wherein machine 10 provides not only axial thrust, but also rotates drill string 28 and bit 34. In such instance, there is of course no need for downhole motor 32.

Figure 2:
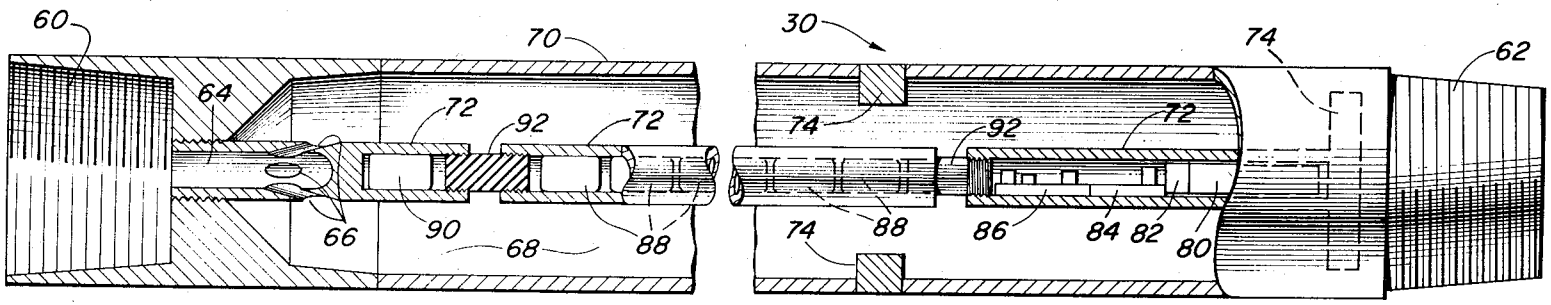
FIG. 2 is a sectional view of a transmitter device according to the invention.

Guidance transmitter 30 will now be more fully described by referring to FIG. 2. Transmitter 30 is configured to connect into a conventional drill string, and is preferably of the same outside diameter as rod 28. It is accordingly provided at its ends with female and male threaded sections 60 and 62 respectively for that purpose. As stated earlier, it engages drill motor 32 and bit 34, shown schematically in FIG. 1, at its forward or downhole end by threads 62. High pressure water for powering motor 32 enters assembly 30 at its left end from the central passage in the next-adjacent drill rod 28, not shown. The water passes into central axial bore 64, and thence outwardly by way of a plurality of radial passages 66 leading to annular space 68. Annular space 68 is located between outer housing 70 and inner housing 72. Inner housing 72 is completely sealed, i.e. closed at both ends, with no openings even for passage e.g. of electrical wires. It is supported within outer housing 70 by a plurality of centering spiders 74. After the water passes spiders 74, it enters motor 32 through its central inlet port, not shown, to provide power as described.

Inner housing 72 contains a sealed self-sufficient sensor-transmitter combination. Its elements are arranged physically as shown in FIG. 2, and their operation will be described in conjunction with FIG. 3. Beginning at the downhole end 62, the elements comprise sensor 80, gamma detector 82, gamma amplifier and power supply 84, interface board 86, battery pack 88, and solenoid-striker assembly 90. In a preferred embodiment, the material of construction of both inner housing 72 and outer housing 70 in the region surrounding sensor 80 is non-magnetic. Inner housing 72 can also be divided into sections by insulating connectors 92 as shown, which simplifies replacement of batteries 88. The section of inner housing 72 surrounding solenoid-striker 90 is preferably explosion-proof. Outer housing 70 is designed to withstand the entire drilling thrust load and, where appropriate, the torsional load of rotary drilling.

Figure 3:
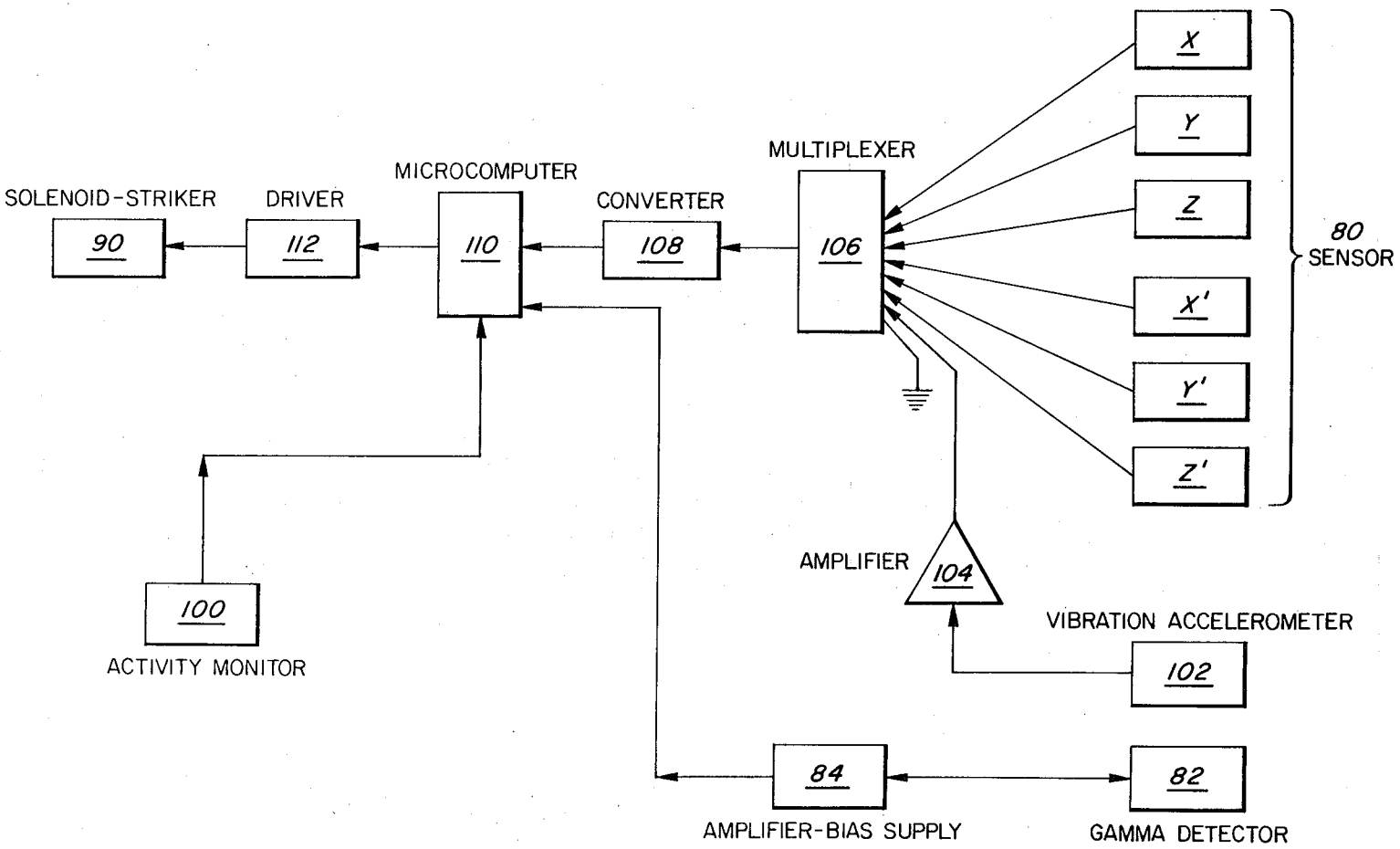
FIG. 3 is a block diagram of circuitry suitable for carrying out the present invention.

Operation of the sensor-transmitter will now be described by referring to FIG. 3. The entire circuitry of FIG. 3 is powered by battery pack 88, shown on FIG. 2 but not on FIG. 3, which pack is preferably a number of sealed rechargeable cells connected in series. Activity monitor 100, which can comprise a sensitive accelerometer, senses the presence or absence of noise indicative of drilling activity within the borehole. After a programmed interval of silence (no drilling activity), monitor 100 activates transmission of encoded data by driver 112 and solenoid-striker assembly 90, which data has been collected and stored by the balance of the circuitry in the interval subsequent to any prior transmission. Sensor 80 comprises accelerometers X, Y and Z oriented on three mutually perpendicular axes, and magnetometers X', Y' and Z' similarly oriented. A signal is also developed by vibration accelerometer 102 and its associated peak-holding amplifier 104. The six signals from sensor 80 and one from amplifier 104 are sequentially gathered by multiplexer 106, which passes them in analog form to A/D (analog-digital) converter 108. This digitized data is passed to microcomputer 110, which can also receive a signal from applifier-bias supply 84 as sensed by gamma detector 82. Sensor 80 can comprise, for example, Develco borehole sensor model 106470-05, available from Develco Inc. of Sunnyvale, Calif. Solenoid-striker 90 can comprise a linear solenoid such as a model L12AM5LE124P24, available from The G. W. Lisk Co. Inc. of Clifton Springs, N.Y. We modify this solenoid by attaching an additional flanged cylindrical metal mass to the end of its plunger, and fitting a light compression or return spring between the solenoid body and the flange. The solenoid body is closely fitted into and acoustically coupled with inner housing 72 and, in turn, outer housing 70. Each energization of solenoid 90 thus results in a loud, highly audible metallic 'rap' as the plunger is drawn into the body, which has been readily detected after transmissions along more than 2800 feet of $2\frac{7}{8}''$ diameter drill string in a coal seam borehole. A battery pack consisting of 12 series-connected sealed rechargeable lead-acid D-cells, powering the noted sensors, solenoid-striker, and associated circuitry, microcomputer, etc., has lasted for more than 250 cycles of data transmission and drill rod section addition in actual drilling operation.

As stated, driver 112 and solenoid-striker 90 transmit a string of data after monitor 100 has sensed a preprogrammed interval of silence, which normally occurs when the borehole has been advanced by one length of rod 28, so that machine 10 is stopped to add another length of rod 28. Data is transmitted as binary, i.e. a 'rap' generated by driver 112 energizing solenoid 90 represents a "1", and a non-rap or silence represents a "0". Returning briefly to FIG. 1, detector 48, which is advantageously located adjacent machine 10, can comprise a microphone which is attached magnetically to drill rod 28. Detected signal 'raps' are passed by wire 50 to display 52. Display 52 is coded to interpret data upon receiving a predetermined transmitted 'start' code, and to then sort it by time sequence to appropriate dial and/or digital display for the guidance of the machine operator. The received data can of course also be recorded, as on magnetic tape, to provide a permanent log of the hole.

A specific example of a suitable string of binary data, which is preferably transmitted at a rate between about 1 and about 10 Hz., is as follows:

| Bit numbers | Data Identity |
|---|---|
| 1–3 | 1-0-1 start code |
| 4–13 | 10 bits of gamma |
| 14–23 | 10 bits of X acceleration |
| 24–33 | 10 bits of Y acceleration |
| 34–43 | 10 bits of Z acceleration |
| 44–53 | 10 bits of X magnetometer |
| 54–63 | 10 bits of Y magnetometer |
| 64–73 | 10 bits of Z magnetometer |
| 74–83 | 10 bits of peak shock acceleration |
| 84,85 | 2 (least significant) bits of X acceleration |
| 86–92 | 7 bits of checksum |

Checksum is the sum of all binary "1"s transmitted, expressed in binary, to enable the receiver to verify accurate reception.

In a preferred embodiment, monitor 100 with its associated circuitry not only activates transmission of a string of data after having detected a predetermined period of drilling inactivity such as one to a few minutes, but also turns off the power to all other elements, e.g. sensor 80 and detector 82, after a longer predetermined interval of drilling inactivity such as from 5 minutes to ½ hour, as occurs between work shifts or overnight. This automatic power-down enables the transmitter to remain downhole for a much longer interval between battery chargings. Monitor 100 and its associated control circuitry remain powered continuously, and reactivate the entire monitoring and transmission cycle upon detecting renewal of drilling activity.

Typically the only maintenance required on the transmitter is occasional replacement of battery pack 88 with a freshly charged battery pack. The segmented arrangement of inner housing 72 facilitates this operation. The relevant borehole data are available on display 52 at the working face continually and rapidly, so that the drilling operator is readily trained in proper use and interpretation of the data. For these reasons, the present invention eliminates the need of an on-site logging specialist.

It is obvious that reasonable variation can be made and still be within the spirit and scope of the invention as disclosed in this specification and the appended claims.

What is claimed is:

1. A system for transmitting data from a transmitter located near the leading end of a string of drill pipe along a string of drill pipe in a borehole to a receiver, said system including:

(a) sensor means positioned near the leading end of said string of drill pipe, said sensor means adapted to measure directional orientation of said borehole and to generate an analog signal responsive to said measurements, (b) converter means connected to said sensor means and adapted to convert said analog signal to a binary digital signal, (c) signal storage means adapted to store digital signals from said converter means, (d) detector means for determining absence of activity of said drill pipe, (e) computer means connected to said detector means, said computer means being adapted to enable activation of a solenoid means responsive to said detector means determining passage of a predetermined time interval during which interval there is absence of activity, (f) electrical battery power means, and (g) electric solenoid means connected to said power means and to said signal storage means, said solenoid means acoustically coupled to said drill pipe near said leading end of said string of drill pipe, said solenoid means being adapted to generate an audible pulse along said string of drill pipe upon activation by said power means responsive to said signal storage means.

2. The system of claim 1 wherein said sensor means measures directional orientation of said in-hole extremity of said drill pipe by means of accelerometers each having mutually perpendicular axes and magnetometers each having mutually perpendicular axes.

* * * * *